US011220119B2

(12) United States Patent
Lo et al.

(10) Patent No.: US 11,220,119 B2
(45) Date of Patent: Jan. 11, 2022

(54) MEDIA SENSING

(71) Applicant: Hewlett-Packard Development Company, L.P., Spring, TX (US)

(72) Inventors: Kevin Lo, Vancouver, WA (US); Jody L Clayburn, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/763,028

(22) PCT Filed: Nov. 20, 2017

(86) PCT No.: PCT/US2017/062652
§ 371 (c)(1),
(2) Date: May 11, 2020

(87) PCT Pub. No.: WO2019/099051
PCT Pub. Date: May 23, 2019

(65) Prior Publication Data

US 2020/0391522 A1 Dec. 17, 2020

(51) Int. Cl.

| | |
|---|---|
| ***B41J 11/00*** | (2006.01) |
| ***B41J 29/02*** | (2006.01) |
| ***B41J 29/13*** | (2006.01) |
| ***B41J 29/38*** | (2006.01) |

(52) U.S. Cl.
CPC ..... *B41J 11/0095* (2013.01); *B41J 29/02* (2013.01); *B41J 29/13* (2013.01); *B41J 29/38* (2013.01)

(58) Field of Classification Search
CPC ..... B41J 11/0095; B41J 29/02; B41J 29/13; B41J 11/003; B41J 11/009; B41J 29/38
See application file for complete search history.

(56) References Cited

U.S. PATENT DOCUMENTS

| | | | |
|---|---|---|---|
| 5,349,199 | A | 9/1994 | Rabjohns et al. |
| 5,615,876 | A | 4/1997 | Yergenson et al. |
| 6,640,059 | B2 | 10/2003 | Fromm et al. |
| 6,668,155 | B1 | 12/2003 | Hubble, III et al. |
| 6,782,214 | B2 | 8/2004 | Hoberock et al. |
| 7,630,675 | B2 | 12/2009 | Tateishi et al. |

(Continued)

FOREIGN PATENT DOCUMENTS

| | | |
|---|---|---|
| CN | 1398725 | 2/2003 |
| CN | 1935522 | 3/2007 |

(Continued)

OTHER PUBLICATIONS

HP—Officejet Enterprise Color X555 Officejet Enterprise Color Mfp X585, Apr. 2014, https://shared.swissparts.ch/manuals/HP—338 pages.

*Primary Examiner* — Jason S Uhlenhake
(74) *Attorney, Agent, or Firm* — Fabian VanCott

(57) ABSTRACT

A media sensing device may include an electromagnetic radiation source, a light guide located on an opposite side of a media feed path respective to the electromagnetic radiation source, and a photodetector to detect electromagnetic radiation from the electromagnetic radiation source and directed by the light guide. The photodetector detects the presence of media upstream from a heated pressure roller (HPR) in response to the media obstructing the detection of electromagnetic radiation from the electromagnetic radiation source.

20 Claims, 6 Drawing Sheets

(56) References Cited

U.S. PATENT DOCUMENTS

| | | | | |
|---|---|---|---|---|
| 9,340,016 | B2 * | 5/2016 | Kritchman | B41J 2/015 |
| 2011/0158729 | A1 * | 6/2011 | Lee | G03G 15/5062 400/578 |
| 2015/0301491 | A1 * | 10/2015 | Yoshikawa | G03G 15/6564 271/3.16 |
| 2016/0090255 | A1 | 3/2016 | Higuchi | |

FOREIGN PATENT DOCUMENTS

| | | | |
|---|---|---|---|
| CN | 10427208 | | 1/2015 |
| CN | 106142866 | | 11/2016 |
| CN | 107000950 | | 8/2017 |
| JP | 2784296 | B2 | 1/1994 |
| JP | 2002341693 | | 11/2002 |
| JP | 5088210 | B2 | 12/2012 |
| JP | 2017081739 | A | 5/2017 |
| KR | 1020040054033 | | 1/2005 |

* cited by examiner

MEDIA SENSING

BACKGROUND

Heated pressure rollers (HPRs) may be used in printing and within printing devices and systems to flatten or iron out media on which fluid may be printed, and to assist in curing the fluids printed on the media, A media feed path may provide a pathway within a printing device in which the HPR resides to allow media on which the printing device prints to move into and out of the HPR. In this manner, the HPR assists the printing device in preparing or finishing printed media.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
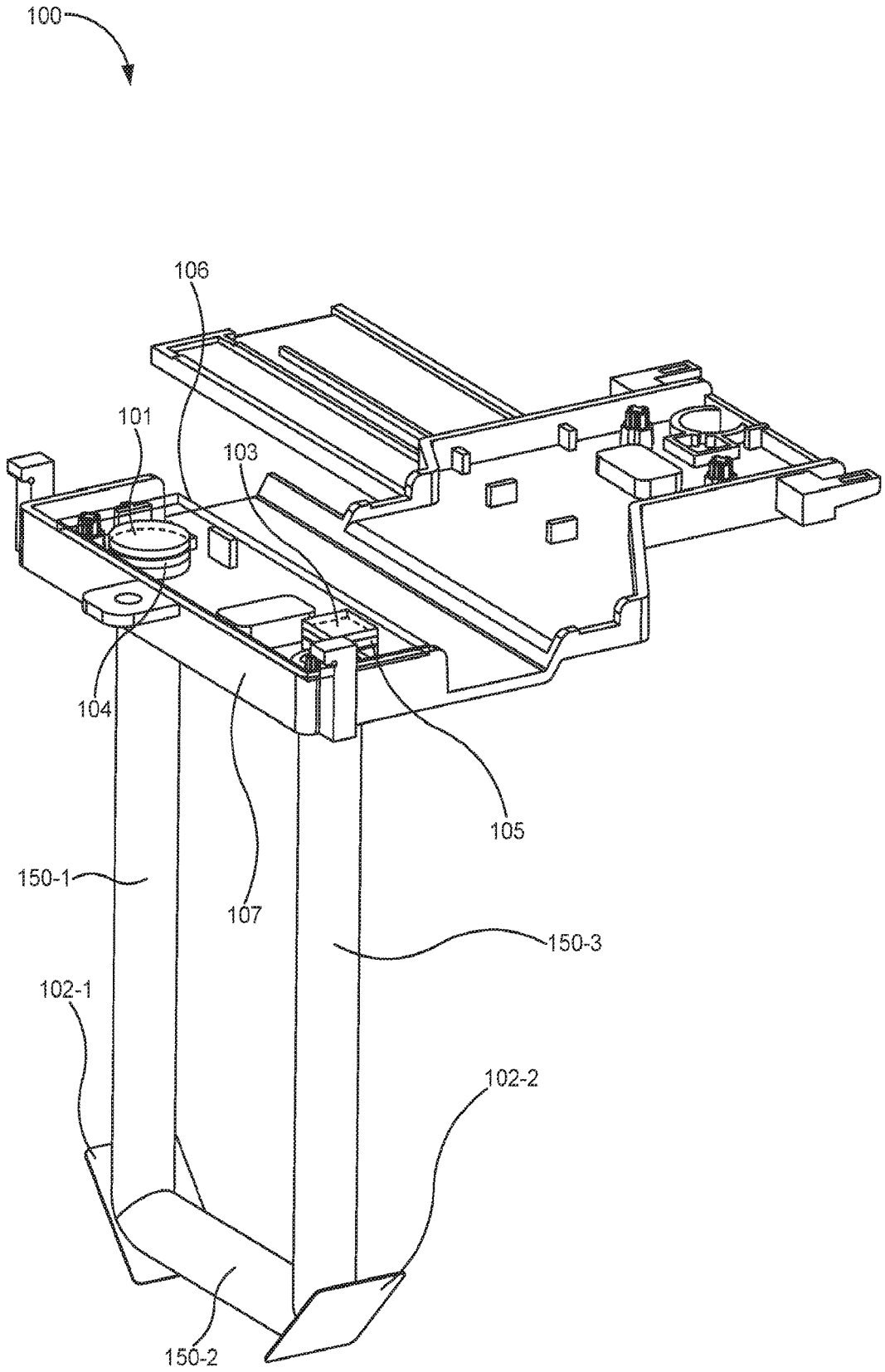
FIG. 1 is a perspective view of a media sensing device, according to an example of the principles described herein.

Throughout the drawings, identical reference numbers designate similar, but not necessarily identical; elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In some instances, media may become obstructed or "jammed" within the HPR. The HPR may include a pressure roller that applies pressure against a heated belt. With the rotation of the pressure roller and the heated belt, the media may become stuck in one of several ways including; for example, wrapped around the heated belt. The wrapping of the media around the heated belt or otherwise improperly fed into the HPR may be referred to as a media obstruction. This improper feeding of the media into and through the HPR results in a printed media that is defective or entirely unsatisfactory as a finished printed product. A media sensing device may be able to detect the presence of media improperly fed into the HPR and stop the HPR and other associated systems from functioning to avoid additional destruction of print media and additional media obstructions.

Further, an HPR unit may produce temperatures of up to 200° C. and steam generated from the ironing process provided by the pressure roller and the heated belt. Placement of a media detection device within the HPR may result in the degeneration of a media detection device due to the extreme heat and water vapor the media detection device would be exposed to within the HPR. Thus, the media detection device may be placed outside the HPR unit, but just before the HPR unit to detect any potential improper feeding of the print media. In this example, the media detection device may be upstream from and placed immediately before the HPR unit.

Further, with the inclusion of a door or other access panel upstream from the HPR relative to the media feed path of the HPR, the media may be further improperly located within the other portions of the printing device such as within the door, between the door and the HPR, or other portions off of a media feed path. In some printing devices including a door, media may get stuck or lodged within the door as a user opens the door or access panel. This door or access panel may be located before the HPR.

Examples described herein provide a media sensing device. The media sensing device may include an electromagnetic radiation source, a light guide located on an opposite side of a media feed path respective to the electromagnetic radiation source, and a photodetector to detect electromagnetic radiation from the electromagnetic radiation source and directed by the light guide. The photodetector detects the presence of media upstream from a heated pressure roller (HPR) in response to the media obstructing the detection of electromagnetic radiation from the electromagnetic radiation source. Stated another way, photodetector detects the presence of media upstream from the HPR in response to the photodetector not detecting the electromagnetic radiation from the electromagnetic radiation source.

The media sensing device may include a first transparent heat shield over the electromagnetic radiation source to protect the electromagnetic radiation source from heat from the HPR. The media sensing device may also include a second transparent heat shield over the photodetector to protect the photodetector from heat from the HPR. The second transparent heat shield may include light diffusion optics.

The a light guide may include two light guides. A first light guide of the two light guides reflects or directs electromagnetic radiation from the electromagnetic radiation source to a second light guide of the two light guide. The second light guide reflects or directs the electromagnetic radiation received from the first light guide to the photodetector. The electromagnetic radiation source and the photodetector are located on separate axis formed from a first electromagnetic radiation path between the electromagnetic radiation source and the first light guide and a second electromagnetic radiation path between the second light guide and the photodetector. In another example, the at least one light guide may include an electromagnetic radiation emitting and detecting device. The electromagnetic radiation emitting and detecting device transmits electromagnetic radiation to one light guide across the media feed path.

Examples described herein also provide a printing device. The printing device may include a heated pressure roller (HPR), a media feed path to feed media into and out from the HPR, and a media sensing device located upstream of the HPR within the media feed path. The media sensing device may include an electromagnetic radiation source, a light guide located on an opposite side of a media feed path respective to the electromagnetic radiation source, and a photodetector to detect electromagnetic radiation from the electromagnetic radiation source and directed by the light guide. The media sensing device detects the presence of media upstream from a heated pressure roller (HPR) in response to the media obstructing the detection of electromagnetic radiation from the electromagnetic radiation source.

The printing device may include an access door. A portion of the media feed path may be defined within the access door, and the media sensing device may be positioned to detect media present within a portion of the access door other than the media feed path.

The electromagnetic radiation source and the photodetector may be included on a common printed circuit assembly (PCA) next to the HPR. The printing device may include at least one feed roller located upstream of the media sensing device within the media feed path. The media sensing device detects the presence of media within the at least one feed roller.

The at least one light guide may include one light guide. In this example, the electromagnetic radiation source and photodetector include an electromagnetic radiation emitting and detecting device, and electromagnetic radiation from the electromagnetic radiation emitting and detecting device is directed from the one light guide to the electromagnetic radiation emitting and detecting device across the media feed path.

The printing device of may include a first transparent heat shield over the electromagnetic radiation source to protect the electromagnetic radiation source from heat from the HPR. The printing device may also include a second transparent heat shield over the photodetector to protect the photodetector from heat from the HPR. The second transparent heat shield may include light diffusion optics.

Examples described herein further provide a media sensing device. The media sensing device may include an electromagnetic radiation source, a light guide located on an opposite side of a media feed path respective to the electromagnetic radiation source, and a photodetector to detect electromagnetic radiation from the electromagnetic radiation source and directed by the light guide, a first transparent heat shield over the electromagnetic radiation source to protect the electromagnetic radiation source from heat, and a second transparent heat shield over the photodetector to protect the photodetector from heat. The media sensing device detects the presence of media upstream from a heated pressure roller (HPR) in response to the media obstructing the detection of electromagnetic radiation from the electromagnetic radiation source. The electromagnetic radiation source and the photodetector may be located on separate axis to permit detection of media in and out of the media feed path.

As used in the present specification and in the appended claims, the term "light guide" is meant to be understood broadly as any optical device used to direct electromechanical radiation in a direction. A light guide may include, for example, mirrors, fiber optics, light tubes, waveguides, lenses, other optical devices, and combinations thereof.

Figure 2:
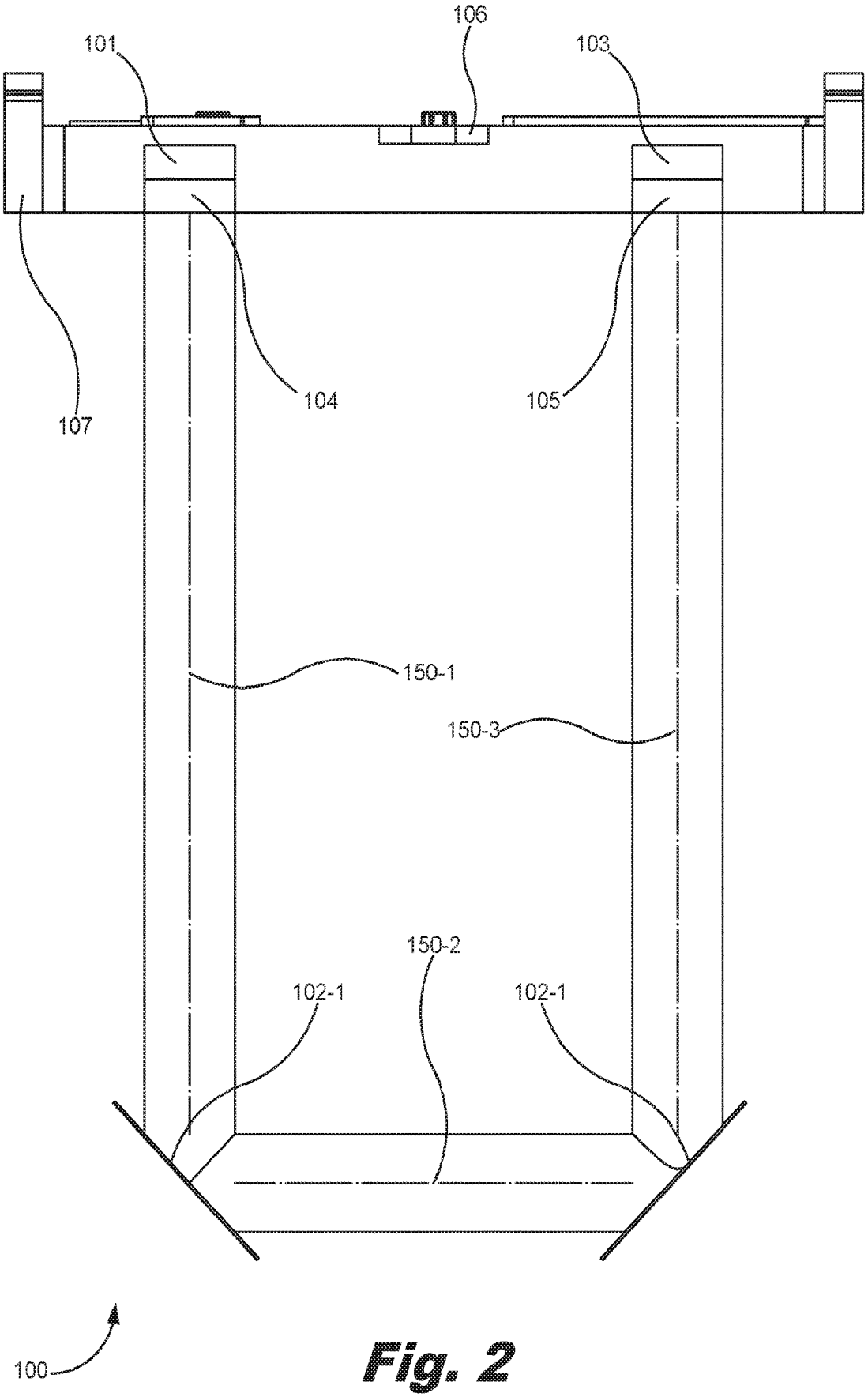
FIG. 2 is a perspective view of the media sensing device of FIG. 1, according to an example of the principles described herein.

Turning now to the figures, FIG. 1 is a perspective view of a media sensing device (100), according to an example of the principles described herein. FIG. 2 is a perspective view of the media sensing device (100) of FIG. 1, according to an example of the principles described herein. The media sensing device (100) is used to detect a wide variety of print media such as paper, photo paper, fabrics, canvas, and other printable substrates. The media sensing device (100) may be located adjacent to a heated pressure roller (HPR), and immediately before and upstream from the HPR with respect the direction of travel of print media through the HPR. In this manner, the media sensing device (100) may detect media that gets improperly feed into or otherwise obstructed in the HPR.

The media sensing device (100) may include an electromagnetic radiation source (101). The electromagnetic radiation source (101) may be any device capable of producing and projecting electromagnetic radiation, and may include, for example, a light emitting diode (LED). In this example, the LED may be able to withstand high temperatures including a maximum operating temperature of the HPR such as, for example, 200° C.

The electromagnetic radiation source (101) may be powered to detect media stuck in and out of a media feed path and within other portions of a printing device. In one example, the electromagnetic radiation source (101) may be powered with constant current such that the electromagnetic radiation provided by the electromagnetic radiation source (101) is continuously on during a detection state. In another example where there may exist a relatively higher light noise environment, the electromagnetic radiation source (101) may be activated and controlled using a current pulse that creates a pattern of electromagnetic radiation from the electromagnetic radiation source (101) that is detectable by a photodetector (103).

The electromagnetic radiation source (101) produces a beam of electromagnetic radiation that may be sent across a media feed path and across other areas of a printing device that are not on the media feed path but at which media may be obstruction or "jammed." The media sensing device (100) may include at least one light guide (102-1, 102-2, collectively referred to herein as 102) located on an opposite side of the media feed path respective to the electromagnetic radiation source (101). In the example of FIGS. 1 and 2, the media sensing device (100) includes two light guides (102). The light guides (102) in the example of FIGS. 1 and 2 are mirrors that direct the electromagnetic radiation emitted by the electromagnetic radiation source (101) to a photodetector. In other examples, however, the light guides (102) may be any optical device used to direct electromechanical radiation in a direction such as, for example, mirrors, fiber optics, light tubes, waveguides, lenses, other optical devices, and combinations thereof.

A photodetector (103) may be included in the media sensing device (100) to detect electromagnetic radiation from the electromagnetic radiation source (101). In the examples described herein, the electromagnetic radiation from the electromagnetic radiation source (101) may be directed by the light guide to the photodetector (103). In instances where the photodetector (103) detects electromagnetic radiation from the electromagnetic radiation source (101), a printing device communicatively coupled to the media sensing device (100) may know that no media is obstructing the media feed path, obstructed in the media feed path, or obstructed in a portion of the printing device outside the media feed path. In contrast, in instances where the photodetector (103) does not detect electromagnetic radiation from the electromagnetic radiation source (101), a printing device communicatively coupled to the media sensing device (100) may know that media is obstructing the media feed path, obstructed in the media feed path, or obstructed in a portion of the printing device outside the media feed path. In other words, the media sensing device (100) detects the presence of media within the media feed path upstream from an HPR in response to the photodetector (103) not detecting the electromagnetic radiation from the electromagnetic radiation source.

The photodetector (103) may be any device that converts light photons into an electrical signal for processing by a signal processing device such as a processor of an associated printing device. Examples of photodetectors include photoemissive devices, photoelectric devices, semiconductive devices, photovoltaic devices, thermal devices, photochemical devices, polarization devices, and graphene/silicon photodetector devices, among others.

The media sensing device (100) may also include a first transparent heat shield (104) over the electromagnetic radiation source (101) to protect the electromagnetic radiation source (101) from heat from the HPR. The first transparent heat shield (104) may be made of any optically transparent material. In one example, the first transparent heat shield (104) may include light focusing optics to focus the electromagnetic radiation emitted by the electromagnetic radiation source (101). In this example, the light focusing optics may include a lens formed into or on the first transparent heat shield (104).

Further, the media sensing device (101) may include a second transparent heat shield (105) over the photodetector (103) to protect the photodetector (103) from heat from the HPR. The second transparent heat shield (105) may be made of any optically transparent material. In one example, the second transparent heat shield (105) may include light diffusion optics to diffuse the electromagnetic radiation before the photodetector (103) so that the photodetector (103) may more readily detect the electromagnetic radiation emitted by the electromagnetic radiation source (101). In this example, the light diffusion optics may include a lens formed into or on the second transparent heat shield (105). In another example, the second transparent heat shield (105) may include light focusing optics to provide for the relatively scattered light entering the second transparent heat shield (105) to be refocused and easier to detect.

In operation, the electromagnetic radiation may be directed along a number of paths (150-1, 150-2, 150-3, collectively referred to herein as 150) of electromagnetic radiation. The electromagnetic radiation source (101) emits electromagnetic radiation in the direction of the first light guide (102-1) along a first path (150-1). The first light guide (102-1) then directs the electromagnetic radiation to the second light guide (102-2) along path (150-2). The second light guide (102-2) then directs the electromagnetic radiation to the photodetector (103) along path (150-3). In this manner, the electromagnetic radiation source (101) and the photodetector (103) exist on two separate axis as defined by path (150-1) and path (150-2).

In one example, the media sensing device (100) may include one light guide (102). In this example, the electromagnetic radiation source (101) and photodetector (103) include an electromagnetic radiation emitting and detecting device that performs both the function of emitting electromagnetic radiation and detecting the electromagnetic radiation. In this example, the electromagnetic radiation from the electromagnetic radiation emitting and detecting device is directed from the one light guide located on an opposite side of the media feed path back to the electromagnetic radiation emitting and detecting device for detection. Further, in this example, one path (150) of electromagnetic radiation is present in the media sensing device (100).

A printed circuit board (PCB) (106) may be included in the media sensing device (100). The PCB (106) may be used to mount the electromagnetic radiation source (101) and the photodetector (103), and provides electrical power and signals to be sent between the electromagnetic radiation source (101) and the photodetector (103), and control circuitry of, for example, a printing device in which the media sensing device (100) is included. A mount (107) may be used to couple the PCB (106) to a portion of the HPR or other portion of the printing device. In one example, the mount (107) is formed to allow for the optical alignment of the PCB (106) with the light guides (102) such that the electromagnetic radiation emitted and detected by the electromagnetic radiation source (101) and photodetector (103), respectively, is correctly emitted and detected in an aligned manner.

Figure 3:
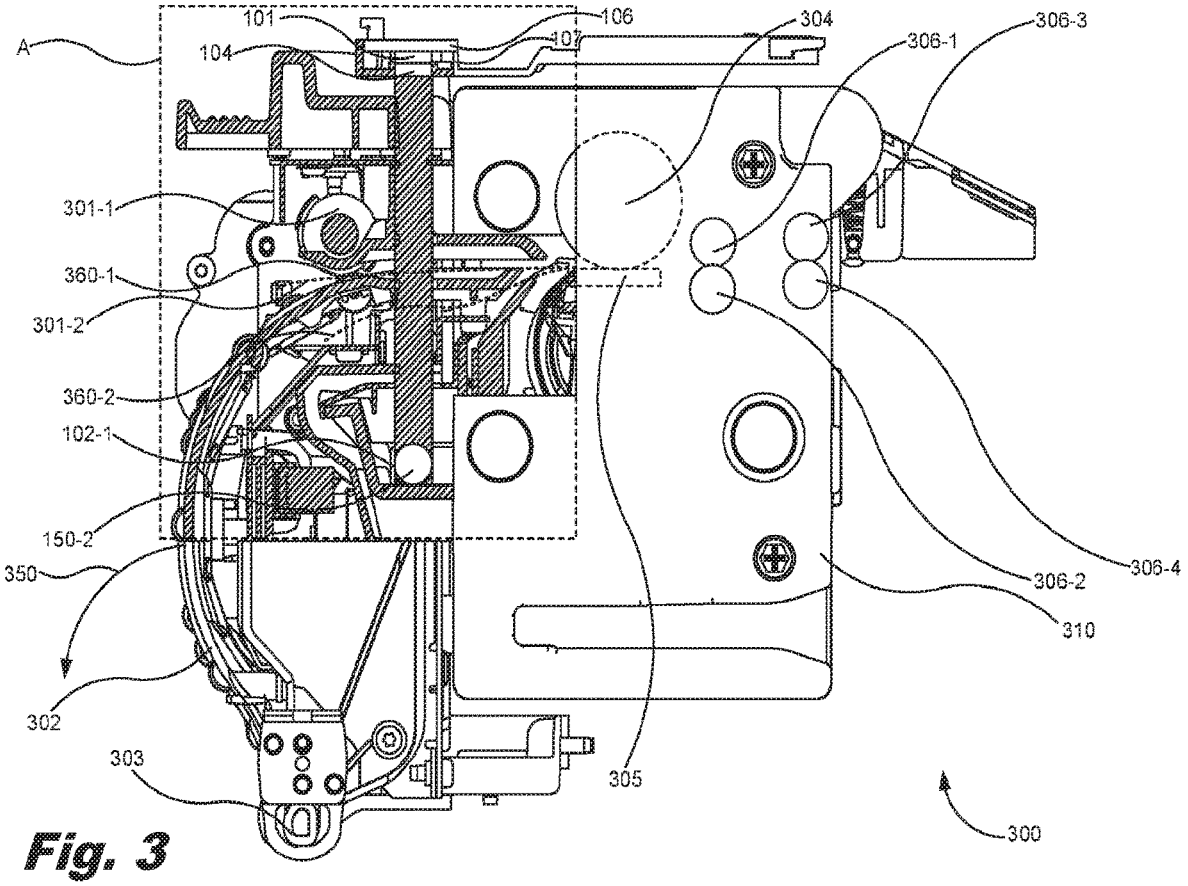
FIG. 3 is a side cutaway view of a printing device including the media sensing device of FIGS. 1 and 2, according to an example of the principles described herein.
Figure 4:
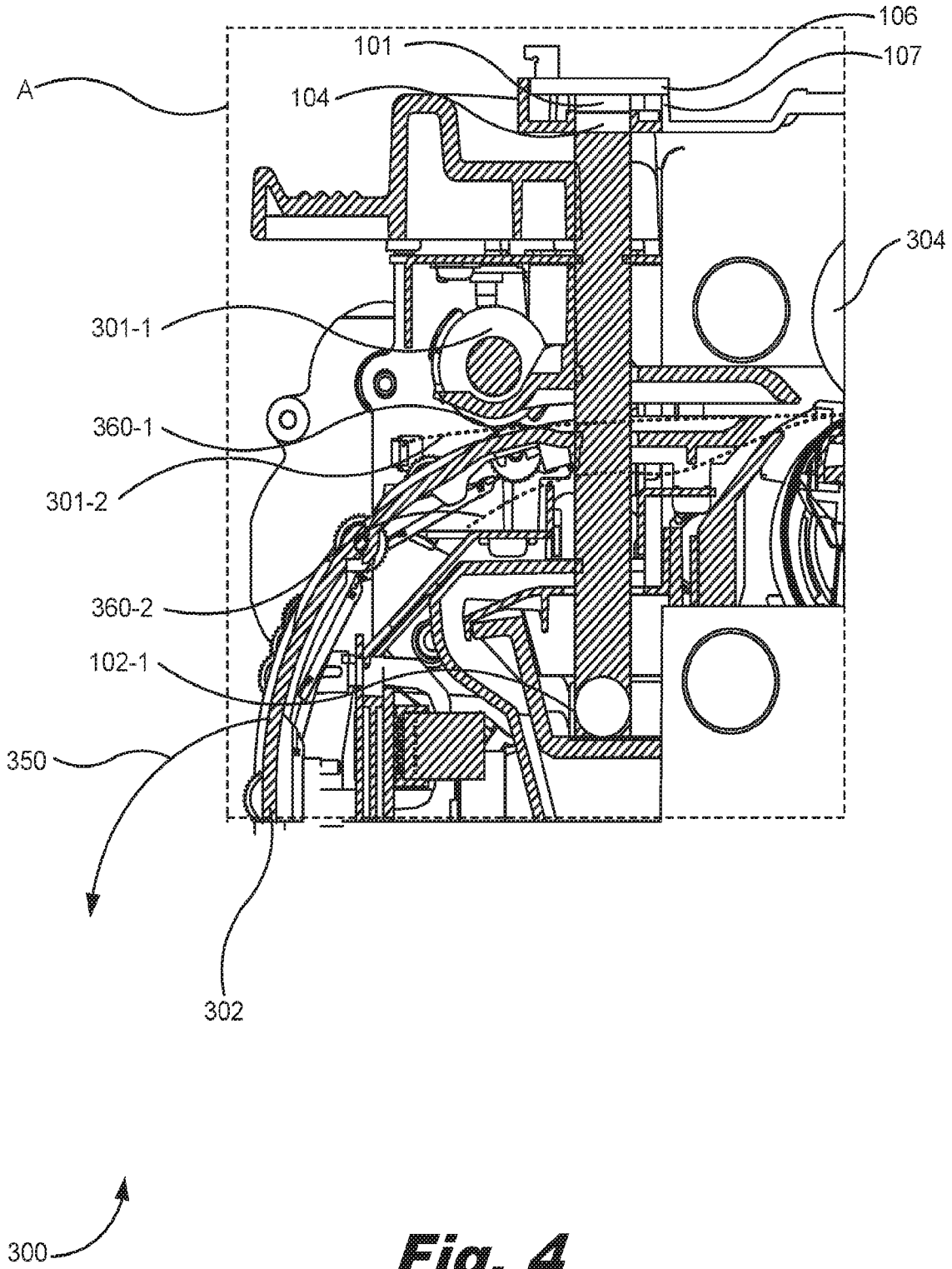
FIG. 4 is a side cutaway view of the printing device of FIG. 3 including the media sensing device of FIGS. 1 and 2 as depicted within box A of FIG. 3, according to an example of the principles described herein.

FIG. 3 is a side cutaway view of a printing device including the media sensing device (100) of FIGS. 1 and 2, according to an example of the principles described herein. Further, FIG. 4 is a side cutaway view of the printing device of FIG. 3 including the media sensing device (100) of FIGS. 1 and 2 as depicted within box A of FIG. 3, according to an example of the principles described herein. The printing device (300) may include a heated pressure roller (HPR) subsystem (310) that includes a pressure roller (304) that applies pressure against a heated belt (305). A number of rollers (301-1, 301-2, 306-1, 306-2, 306-3, 306-4) feed media into and out of the HPR subsystem (310) along a media feed path that pulls the media into the HPR using rollers (301-1, 301-2), feeds the media between the pressure roller (304) and heated belt (305), and pulls the media from the HPR subsystem (310) using rollers (306-1, 306-2, 306-3, 306-4).

The pressure roller (304) of the HPR subsystem (310) places pressure against the heated belt (305) such that the heat from the heated belt (305) and the pressure from the pressure roller (304) causes the media to be flattened or ironed. The HPR subsystem (310) exerts a large amount of pressure on the media and the heated belt (305) of the HPR subsystem (310). Further, the heated belt (305) imparts relatively high temperatures on the media. In instances where the media becomes obstructed or otherwise stuck in the printing device (300) including in the HPR subsystem (310) and upstream from the HPR subsystem (310), the media may become damaged due to these high pressures and temperatures. Therefore, the present media sensing device (100) assists in identifying these media obstructions and may make a user aware of the media obstruction so that the user may remedy the media obstruction.

The media may be obstructed or "jammed" along a media feed path as indicated by line (360-1). In this example, the media may be stuck within portions of the HPR subsystem (310) such as, for example, around the pressure roller (304) and heated belt (305). Thus, media obstructions may occur in a media feed path. Further, in some examples, the printing device (300) may include a door (302) that is rotatably coupled to a hinge (303) such that the door may be opened in the direction of arrow (350) and portions of the printing device (300) may be exposed for servicing. In operation of the door, a user may inadvertently cause media to be stuck between the door and other portions of the printing device (300). Thus, the media may also be stuck off of the media feed path as indicated by line (360-2).

This, in order to be able to detect for these media obstructions both in and out of the media feed path, the paths (150) of emitted and directed electromagnetic radiation may extend past any possible areas at which the media may be stuck. For example, as depicted in FIGS. 3 and 4, the paths (150) of emitted and directed electromagnetic radiation may extend past line (360-1) and line (360-2), With this arrangement, even media that is stuck within the printing device (300) well off of the media feed path may be detected.

A number of remedial actions may be taken in order to correct the media obstruction when detected by the media sensing device (100), In one example, the detection of media stuck within the printing device (300) may be used to alert a user of the printing device that media is stuck within the printing device (300). In another example, the detection of media stuck within the printing device (300) may cause the printing device (300), the HPR subsystem (310), or combinations thereof to cease operation including a number of the rollers (301-1, 301-2, 306-1, 306-2, 306-3, 306-4), the movement of the pressure roller (304) and heated belt (305), heating of the heated belt (305), or combinations thereof. These remedial measures may at least cause the media obstruction to not be exasperated, and be remedied without causing damage to the print media or the printing device (300).

Figure 5:
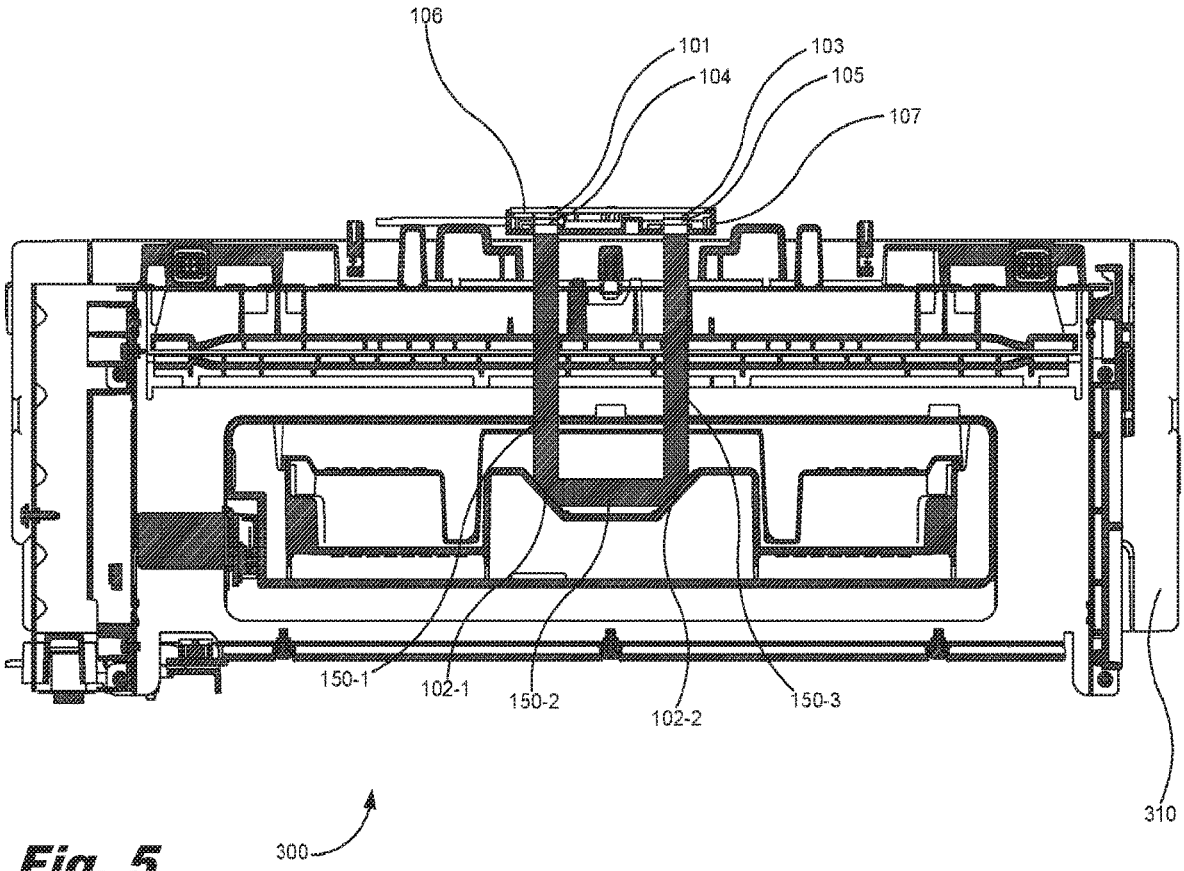
FIG. 5 is a cutaway perspective view of the printing device of FIG. 3 depicting the media sensing device, according to an example of the principles described herein.

FIG. 5 is a cutaway perspective view of the printing device (300) of FIG. 3 depicting the media sensing device (100), according to an example of the principles described herein. The cutaway perspective view of the printing device (300) depicts the media sensing device (100) coupled to the printing device (300) upstream from the HPR subsystem (310). In FIG. 5, all three paths (150-1, 150-2, 150-3) of the electromagnetic radiation are depicted as they are emitted by the electromagnetic radiation source (101), directed by the light guides (102-1, 102-2), and detected by the photodetector (103), The two separate axis as defined by path (150-1) and path (150-2) are also depicted in FIG. 5.

Figure 6:
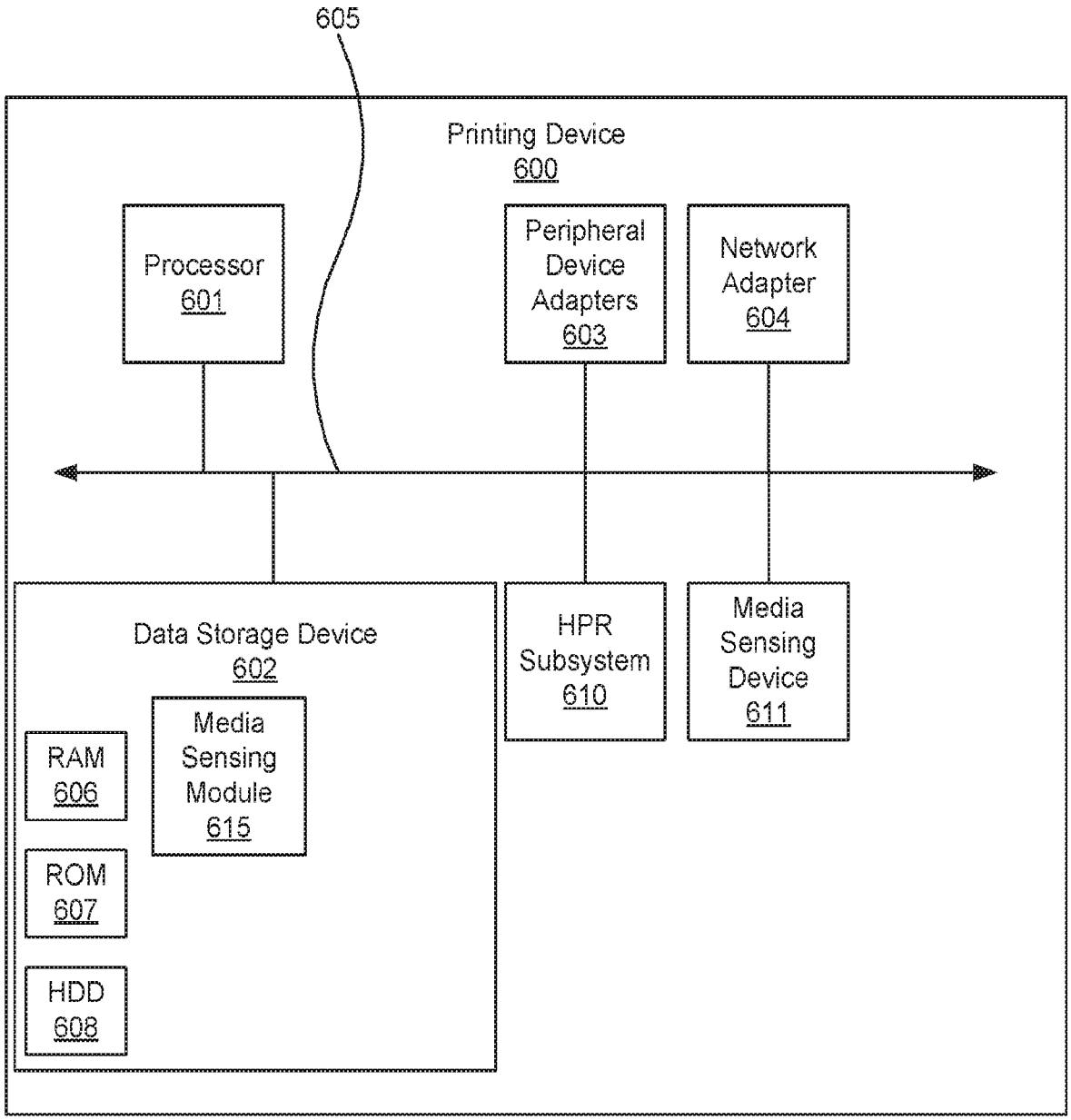
FIG. 6 is a block diagram of a printing device, according to an example of the principles described herein.

FIG. 6 is a block diagram of a printing device (600), according to an example of the principles described herein. The printing device (600) may be any device capable of creating images on media and is compatible with the HPR subsystem (310). Further, the printing device (600) may be utilized in any data processing scenario including, standalone hardware, mobile applications, through a computing network, or combinations thereof. Further, the printing device (600) may be used in a computing network, a public cloud network, a private cloud network, a hybrid cloud network, other forms of networks, or combinations thereof. In one example, the methods provided by the printing device (600) are provided as a service over a network by, for example, a third party. In this example, the service may comprise; for example, the following: a Software as a Service (SaaS) hosting a number of applications; a Platform as a Service (PaaS) hosting a computing platform comprising, for example, operating systems, hardware, and storage, among others; an Infrastructure as a Service (IaaS) hosting equipment such as, for example, servers, storage components, network, and components, among others; application program interface (API) as a service (APIaaS), other forms of network services, or combinations thereof. The present systems may be implemented on one or multiple hardware platforms, in which the modules in the system can be executed on one or across multiple platforms. Such modules can run on various forms of cloud technologies and hybrid cloud technologies or offered as a SaaS (Software as a service) that can be implemented on or off the cloud. In another example, the methods provided by the printing device (600) are executed by a local administrator.

To achieve its desired functionality, the printing device (600) comprises various hardware components. Among these hardware components may be a number of processors (601), a number of data storage devices (602), a number of peripheral device adapters (603); and a number of network adapters (604). These hardware components may be interconnected through the use of a number of busses and/or network connections. In one example, the processor (601), data storage device (602), peripheral device adapters (603), and a network adapter (604) may be communicatively coupled via a bus (605).

The processor (601) may include the hardware architecture to retrieve executable code from the data storage device (602) and execute the executable code. The executable code may, when executed by the processor (601), cause the processor (601) to implement at least the functionality of detecting, with the media sensing device (100), the presence of a media obstruction or "jam," notify a user of the media obstruction; cause the printing device (300); the HPR subsystem (310), or combinations thereof to cease operation in response to a detection of a media obstruction, or combinations thereof, according to the methods of the present specification described herein. In the course of executing code, the processor (601) may receive input from and provide output to a number of the remaining hardware units.

The data storage device (602) may store data such as executable program code that is executed by the processor (601) or other processing device. As will be discussed, the data storage device (602) may specifically store computer code representing a number of applications that the processor (601) executes to implement at least the functionality described herein.

The data storage device (602) may include various types of memory modules, including volatile and nonvolatile memory. For example, the data storage device (602) of the present example includes Random Access Memory (RAM) (606), Read Only Memory (ROM) (607), and Hard Disk Drive (HOD) memory (608). Many other types of memory may also be utilized, and the present specification contemplates the use of many varying type(s) of memory in the data storage device (602) as may suit a particular application of the principles described herein. In certain examples, different types of memory in the data storage device (602) may be used for different data storage needs. For example, in certain examples the processor (601) may boot from Read Only Memory (ROM) (607), maintain nonvolatile storage in the Hard Disk Drive (HDD) memory (608), and execute program code stored in Random Access Memory (RAM) (606). The data storage device (602) may comprise a computer readable medium, a computer readable storage medium, or a non-transitory computer readable medium, among others. For example, the data storage device (602) may be, but not limited to, an electronic, magnetic, optical, electromagnetic, infrared, or semiconductor system, apparatus, or device, or any suitable combination of the foregoing. More specific examples of the computer readable storage medium may include, for example, the following: an electrical connection having a number of wires, a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The hardware adapters (603, 604) in the printing device (600) enable the processor (601) to interface with various other hardware elements, external and internal to the printing device (600). For example, the peripheral device adapters (603) may provide an interface to input/output devices, such as, for example, external computing devices, display devices, a mouse, or a keyboard. The peripheral device adapters (603) may also provide access to other external devices such as an external storage device, a number of network devices such as, for example, servers, switches, and routers, client devices, other types of computing devices, and combinations thereof.

The printing device (600) may, when executed by the processor (601), display the number of graphical user interfaces (GUIs) on a display device associated with the executable program code representing the number of applications stored on the data storage device (602). Examples of display devices include a computer screen, a laptop screen, a mobile device screen, a personal digital assistant (FDA) screen, and a tablet screen, among other display devices.

The printing device (600) further comprises a number of modules used in the implementation of the functionality described herein. The various modules within the printing device (600) comprise executable program code that may be executed separately. In this example, the various modules may be stored as separate computer program products. In another example, the various modules within the printing device (600) may be combined within a number of computer program products; each computer program product comprising a number of the modules.

The printing device (600) may include a media sensing module (615) to, when executed by the processor (601), obtain data from the media sensing device (611) and use that data to take a remedial measure in order to correct the media obstruction when detected by the media sensing device (100). In one example, the detection of media stuck within the printing device (300) may be used by the media sensing module (615) to alert a user of the printing device that media is stuck within the printing device (300). In another example, the detection of media stuck within the printing device (300) may be used by the media sensing module (615) to cause the printing device (300), the HPR subsystem (310), or combinations thereof to cease operation including a number of the rollers (301-1, 301-2, 306-1, 306-2, 306-3, 306-4), the movement of the pressure roller (304) and heated belt (305), heating of the heated belt (305), or combinations thereof. These remedial measures may at least cause the media obstruction to not be exasperated, and be remedied without causing damage to the print media or the printing device (300).

In the examples described herein, the media sensing device (100) may also be used to detect whether a module containing the light guides is missing. As depicted in FIGS. 3 through 5, the light guides (102) may be formed as part of the HPR subsystem (310) with the PCB (106) and its electromagnetic radiation source (101) and photodetector (103) being coupled to a portion of an overall device that may be decoupled from the HPR subsystem (310). Because these two portions may be decoupled, and because the light guides (102) and the PCB (106), electromagnetic radiation source (101), and photodetector (103) may be separated from one another upon the decoupling, the media sensing device (100) may also be used to detect whether the HPR subsystem (310) is coupled to the rotating paper path formed by the rollers (301-1, 301-2, 306-1, 306-2, 306-3, 306-4). In this manner, the media sensing device (100) may also be used to detect whether subassemblies within a printing device, for example are coupled to one another.

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general-purpose computer, special purpose computer, or other programmable data processing apparatus to produce a machine, such that the computer usable program code, when executed via, for example, the processor (601) of the printing device (600) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a media sensing device may include an electromagnetic radiation source, at least one light guide located on an opposite side of a media feed path respective to the electromagnetic radiation source, and a photodetector to detect electromagnetic radiation from the electromagnetic radiation source and directed by the light guide. The media sensing device detects the presence of media upstream from a heated pressure roller (HPR) in response to the photodetector not detecting the electromagnetic radiation from the electromagnetic radiation source.

The examples described herein provide a non-contact media sensing method for improved reliability. Further, the examples described herein are able to detect media in multiple locations within and outside a media feed path. Further, the examples described herein also keep sensor components away from high heat and steam of the HPR while being able to detect the presence and correct installation of the HPR.

The preceding description has been presented to illustrate and describe examples of the principles described. This description is not intended to be exhaustive or to limit these principles to any precise form disclosed. Many modifications and variations are possible in light of the above teaching.

What is claimed is:

1. A media sensing device comprising:

an electromagnetic radiation source;

a light guide located on an opposite side of a media feed path respective to the electromagnetic radiation source; and a photodetector to detect electromagnetic radiation from the electromagnetic radiation source and directed by the light guide, wherein the photodetector detects the presence of media upstream from a heated pressure roller (HPR) in response to the media obstructing the detection of electromagnetic radiation from the electromagnetic radiation source.

2. The media sensing device of claim 1, comprising a first transparent heat shield over the electromagnetic radiation source.

3. The media sensing device of claim 1, comprising a second transparent heat shield over the photodetector.

4. The media sensing device of claim 3, wherein the second transparent heat shield comprises light diffusion optics.

5. The media sensing device of claim 1, comprising:
a first light guide; and
a second light guide,
wherein the first light guide directs electromagnetic radiation from the electromagnetic radiation source to a second light guide of the two light guides,
wherein the second light guide directs the electromagnetic radiation received from the first light guide to the photodetector, and
wherein the electromagnetic radiation source and the photodetector are located on separate axis formed from a first electromagnetic radiation path between the electromagnetic radiation source and the first light guide and a second electromagnetic radiation path between the second light guide and the photodetector.

6. The media sensing device of claim 1, comprising:
an electromagnetic radiation emitting and detecting device,
wherein the electromagnetic radiation emitting and detecting device transmits electromagnetic radiation to one light guide across the media feed path.

7. The media sensing device of claim 1, wherein the light guide is on a vertically opposite side of the media feed path respective to the electromagnetic radiation source.

8. The media sensing device of claim 1, wherein:
the electromagnetic radiation source and the photodetector are on a first side of the media feed path;
the light guide is located on a second side of the media path that is vertically opposite the second side; and
media passes between the electromagnetic radiation source and the light guide.

9. The media sensing device of claim 1, wherein the electromagnetic radiation source is to create a pattern of electromagnetic radiation that is to be detected by the photodetector.

10. A printing device comprising:
a heated pressure roller (HPR);
a media feed path to feed media into and out from the HPR; and
a media sensing device located upstream of, and adjacent to, the HPR within the media feed path, the media sensing device comprising:
an electromagnetic radiation source;
a light guide located on an opposite side of a media feed path respective to the electromagnetic radiation source; and
a photodetector to detect electromagnetic radiation from the electromagnetic radiation source and directed from the light guide,
wherein the media sensing device detects the presence of media upstream from an HPR in response to the media obstructing the detection of electromagnetic radiation from the electromagnetic radiation source.

11. The printing device of claim 10, comprising an access door, wherein a portion of the media feed path is defined within the access door, and wherein the media sensing device is positioned to detect media present within a portion of the access door other than the media feed path.

12. The printing device of claim 10, wherein the electromagnetic radiation source and the photodetector are included on a common printed circuit assembly (PCA) next to the HPR.

13. The printing device of claim 10, comprising a feed roller located upstream of the media sensing device within the media feed path,
wherein the media sensing device detects the presence of media within the feed roller.

14. The printing device of claim 10, comprising:
an electromagnetic radiation emitting and detecting device,
wherein the electromagnetic radiation emitting and detecting device transmits electromagnetic radiation to one light guide across the media feed path.

15. The printing device of claim 10, comprising a first transparent heat shield over the electromagnetic radiation source to protect the electromagnetic radiation source from heat from the HPR.

16. The printing device of claim 10, comprising a second transparent heat shield over the photodetector to protect the photodetector from heat from the HPR, wherein the second transparent heat shield comprises light diffusion optics.

17. The printing device of claim 10, further comprising a media sensing module to take a remedial action to correct a media obstruction detected by the media sensing device.

18. The printing device of claim 17, wherein the remedial action comprises ceasing operation of the HPR.

19. A media sensing device comprising:
an electromagnetic radiation source to produce a beam of electromagnetic radiation to be sent across a media feed path;
a light guide located on an opposite side of a media feed path respective to the electromagnetic radiation source;
a photodetector to detect electromagnetic radiation from the electromagnetic radiation source and directed by the light guide;
a first transparent heat shield over the electromagnetic radiation source to protect the electromagnetic radiation source from heat; and
a second transparent heat shield over the photodetector to protect the photodetector from heat,
wherein the photodetector detects the presence of media outside a media feed path in response to the media obstructing the detection of electromagnetic radiation from the electromagnetic radiation source.

20. The media sensing device of claim 19, wherein the electromagnetic radiation source and the photodetector are located on separate axis to permit detection of media in and out of the media feed path.

* * * * *